United States Patent [19]

Meirovitz

[11] 4,251,078

[45] Feb. 17, 1981

[54] GUESSING GAME

[75] Inventor: Mordechai Meirovitz, Haifa, Israel

[73] Assignee: Mego Corp., New York, N.Y.

[21] Appl. No.: 967,661

[22] Filed: Dec. 8, 1978

[51] Int. Cl.[3] ..... A63F 9/18

[52] U.S. Cl. ..... 273/265

[58] Field of Search ..... 273/265

[56] References Cited

U.S. PATENT DOCUMENTS

| | | | |
|---|---|---|---|
| 2,575,269 | 11/1951 | Hall | 273/265 X |
| 3,149,842 | 9/1964 | Cirrincione | 273/265 |
| 3,545,761 | 12/1970 | Brooks et al. | 273/265 |
| 3,865,381 | 2/1975 | Hayes | 273/287 X |
| 3,899,176 | 8/1975 | Gregan | 273/236 X |
| 4,059,275 | 11/1977 | Price | 273/265 |
| 4,073,494 | 2/1978 | McAdams | 273/150 |

FOREIGN PATENT DOCUMENTS

| | | | |
|---|---|---|---|
| 582709 | 9/1959 | Canada | 273/265 |
| 475243 | 2/1915 | France | 273/265 |

*Primary Examiner*—Anton O. Oechsle
*Attorney, Agent, or Firm*—Bertram Frank

[57] ABSTRACT

A game board for a guessing game includes a number of separate game board elements each for one of the players of the game. Each game board element includes four groups of recesses which, within each group, are arranged in rows indicated by numerals, and in columns indicated by alphabet letters. Each of the groups is associated with one of the players and is identified as such by a symbol of the respective player. A shield is mounted on the respective game board element and conceals the same from view by the other players. The shield has a set of predetermined patterns thereon from which each player selects one and positions one or more indicators into the respective recesses of one of the groups in accordance therewith. The players, in turn, call for the intersections of the rows and columns of the other players to determine whether an indicator is present or absent from the particular intersection. The presence or absence of the indicator from the respective intersection has to be revealed by the questioned player. Each player indicates the presence and absence of the indicators from the intersections of the other players in the proper groups of recesses by indicators which are of a different color for indicating the presence than for indicating the absence of the indicators of the others players. When the presence of a sufficient number of indicators has been revealed, the players may guess the pattern selected by the other players.

1 Claim, 6 Drawing Figures

GUESSING GAME

BACKGROUND OF THE INVENTION

The present invention relates to a game in general, and more particularly to a game which involves a determination and/or guessing of a pattern selected by the opposing player or players from a limited number of patterns available for selection.

Various games involving somewhat similar concepts are already known. Thus, for instance, it is already known to arrange differently configurated targets on a grid of columns and rows in such a manner as to be concealed from an opposing player, and to eliminate these targets by calling for particular intersections of the rows and columns of the opposing player. If a target is present at the particular intersection, it will be "hit" and then the vicinity of the intersection will be explored to determine whether any other portions of the target may be present thereat. As challenging as this game may be, it still offers only a limited range of possibilities and requires a low amount of skill, imagination and foresight. The element of chance and luck plays a very important role in this game and, for all intents and purposes, no strategy can be developed for playing the game.

SUMMARY OF THE INVENTION

Accordingly, it is the general object of the present invention to avoid the disadvantages of the prior art.

More particularly, it is an object of the present invention to develop a game which is not possessed of the above-enumerated disadvantages.

Still another object of the present invention is to provide a game which is simple in construction, easy to master any yet very challenging and requiring a high degree of imagination logic reasoning and foresight.

A concomitant object of the present invention is to provide a method of playing the game, which involves logical reasoning perception and imagination of the player to an extent which considerably exceeds the element of luck.

In pursuance of these objects and others which will become apparent hereafter, one feature of the present invention resides in a game which, briefly stated, comprises a game board including at least two spaced playing portions each for use by one of at least two players and each having markings thereon which are indicative of playing locations arranged at intersections of at least two intersecting arrays of imaginary lines; and at least one set of indicators adapted to be so positioned at the playing locations as to be observable by the respective one and concealed from the other of the players and to form a pattern on the respective playing portion which conforms to at least one of a limited set of patterns available to the players for selection at the beginning of a particular game, and to be removed from the respective playing location of the playing portion of the one player when the position thereof at the respective intersection of the imaginary lines of the arrays is correctly guessed by the other player.

It may be seen from the above that an important aspect of the invention resides in the utilization of a limited set of patterns from which the pattern to be placed on the playing portion of the respective player can be selected. Inasmuch as the number of available patterns in a particular game is limited, it is no longer necessary, as it was in the above-discussed conventional game, to determine each and every intersection at which the target or indicator is located. Rather, it is sufficient for each player to find out the presence or absence of the indicators at a number of intersections of the playing portion of the opposing player which is sufficient for the one player to be certain of, or to make an intelligent guess about, the pattern selected by the opposing player.

The playing portions, the markings, and the indicators make take various forms. However, it is advantageous, as proposed by the present invention, when the markings include means for defining recesses in the playing portions at the intersections, the recesses being operative for at least partially receiving the indicators. It is further advantageous when each of the indicators is a peg having a first portion received in the respective recess, and a second portion accessibly located outwardly of the respective recess, in an assembled condition thereof with the playing portion. In this context, it is especially advantageous when the peg is substantially mushroom-shaped having a leg and a head which respectively constitute the first and second portions of the peg.

When this particular construction is resorted to, it is very simple and easy to establish the selected pattern on the playing portion by locating the indicators at some but not all of the intersections, that is, in the respective recesses. In this construction, the indicators or pegs are capable of being selectively located at, and withdrawn from, the respective recesses, which is especially advantageous in view of the fact that it avoids confusion.

While it would be, at least, theoretically possible to manage with only one set of indicators which would then indicate only the patterns selected by the respective players, it is further advantageous when an additional set of additional indicators is provided, which are similar to and visually differentiated from, the above-mentioned indicators and which are adapted to be positioned at the respective playing location of the playing portion of the one player upon calling for an unoccupied intersection of the other player. In this manner, the one player is capable of recording the intersections which he had already called for to thus avoid the possibility that the same intersection would be called for repeatedly. Advantageously, all of the indicators have the same shape, but the sets of indicators differ from each other in color. Because of having the same shape, the indicators are easy to manufacture, for instance, by injection molding of a synthetic plastic material in a die of the like, since the same die can be used for manufacturing both sets of indicators by merely changing the color of the synthetic plastic material which is being injected for each of the sets of indicators.

Of course, it is very important, in the context of this game, that it be assured that the opposing players cannot observe each other's playing portions and the distribution of the indicators thereon. Thus, it is proposed by the present invention to provide means for concealing the respective playing surfaces of the playing portions, which have the markings thereat, of each of the players, from the respective other player or players. Advantageously, the concealing means includes at least one shield situated intermediate the players. It is further advantageous when a separate shield is provided for each of the playing portions, and when means is provided for connecting the shields of the respective playing portions. In this manner, each of the players is in an exclusive control of his or her shield by virtue of its connection to the respective playing portion so that, barring improper conduct by the other players, he or she can so arrange the shield as to effectively prevent the other players from viewing his or her playing surface and the indicators distributed thereon.

It is further advantageous, in accordance with an additional aspect of the present invention, when each of the playing portions has a slot therein at the side of the playing surface which is remote from the respective player, and when the connecting means includes a projecting portion of the respective shield which is received in the slot in an assembled condition of the shield with the respective playing portion. This arrangement is very simple in construction and renders it possible to readily reorient the shield, or substitute a different shield therefor, in the interim between two successive games.

It is further advantageous when the shield includes a central portion and two lateral portions which are hingedly connected to the central portion. When the shield is constructed in this way, it is possible to pivot the lateral portions relative to the central portion so that the lateral portions will flank the playing surface from the sides thereof and thus conceal the same even from those players who are not situated directly opposite the respective player.

It is further advantageous when the shield is substantially flat and has two major surfaces at least one of which has the set of patterns thereon. Then, it is also advantageous, as proposed by the present invention, to provide a different set of patterns on the other major surface. In this manner, a different limited set of patterns will be available to each player for selection therefrom in each orientation of the shield, that is, when the one major surface, or the other major surface, faces the respective player.

While the playing portions could be parts of a unitary game board, it is currently preferred that they be respectively provided on discrete game board elements, each of which is to be used by one of the opposing players. In this manner, the possibility of interference of one player with the shield or playing portion of the other player is minimized if not eliminated.

In order for the players to be able to precisely indicate and conveniently locate the intersection in question, each of the playing portions is advantageously provided with a number of different characters, each of the characters being located on one of the imaginary lines to identify the same. It is further advantageous when the characters include a separate set of alphanumeric symbols for each of the arrays. Preferably, one of the set of alpha-numeric symbols includes only alphabet letters, while the other set includes only numerals. When this is done, a particular intersection of the imaginary lines constituting the arrays can be conveniently called for, and just as easily and precisely located, when called for, by appropriately combining the alphanumeric characters of the two sets with one another when making an inquiry.

So far, the game of the present invention has been discussed as it would or could be constituted when having only two players in mind. However, the present invention, as currently proposed, is intended to be capable of being used not only by two, but also by three, four, or even more players. To be able to do this, it is proposed, in accordance with the present invention, to provide the game board with at least one additional playing portion for use by an additional player, and to arrange the markings of each of the playing portions in a number of identical groups the number of which corresponds to the total number of the playing portions available in the game. In this manner, each of the players will be able to use one of the groups of markings to create his or her own pattern thereon, while using the remaining groups for indicating intersections of the other players which have already been inquired about during the course of the game and from which the indicators are absent, or on which the indicators are present, in each group of markings of the other players.

Especially in the event that more than two players are playing the guessing game of the present invention, it is advantageous when each of the groups of markings is identified by a different symbol provided on the playing portions, so as to be able to identify the respective group of markings being inquired about and the player associated with this particular group. In this connection, it is especially advantageous when these symbols correspond to those which indicate the card suits, that is, a heart, a diamond, a spade, and a club.

Another important aspect of the present invention resides in a method of playing the guessing game of the present invention with the components which have been discussed above. This method, as currently contemplated, includes, for each one of the players, the steps of selecting a pattern from a limited number of patterns available for selection at the beginning of the particular game; positioning the indicators at those markings which are indicated in the respective pattern; calling, in turn with the other player or players, for a particular intersection of the other player; revealing the presence of an indicator at, or its absence from, a called-for intersection of the playing portion of the one player; and guessing the pattern present on the playing portion of the other player when a sufficient amount of information is available to the one player to be able to make an intelligent guess.

Here again, an important factor of the method of the present invention resides in the limited number of choices which are available to the players in selecting the patterns to be formed on the playing portion. The method of the present invention, while depending to a certain extent on chance, primarily relies on the ingenuity of the respective player in selecting the intersections to be inquired about, and an ability of the player to imagine, based on only a few identified intersections of the opposing player, or attempt to guess the pattern selected by the opposing player.

The method of the present invention also advantageously includes the step of situating an indicator at a marking of a section of the playing portion of the one player which is associated with the other player, which marking is located at an intersection called for by the one player. In this manner, the respective player can make a record of the intersections already inquired about. This step is particularly advantageous when, in accordance with a further aspect of the invention, two sets of differently colored indicators are provided. Then the situating step includes placing at the respective marking an indicator of one of the sets of indicators in the event of presence of an indicator at, and an indicator of the other set of indicators in the event of absence of an indicator from, the called-for intersection of the other player. In this manner, the respective player will be able to establish a complete record concerning the presence and absence of indicators at or from the already called-for intersections of the other player or players.

It may be seen from the above explanation that the present invention provides a game, as well as a method of playing the game, which satisfy the above objects and which particularly present a new challenge even to expert players of conventional games of this nature.

Other aspects and advantages of the invention will become more apparent by reference to the following detailed description when considered in connection with the accompanying drawings in which the same or similar reference numerals designate like or corresponding parts throughout the various views.

DETAILED DISCUSSION OF THE PREFERRED EMBODIMENT

Figure 1:
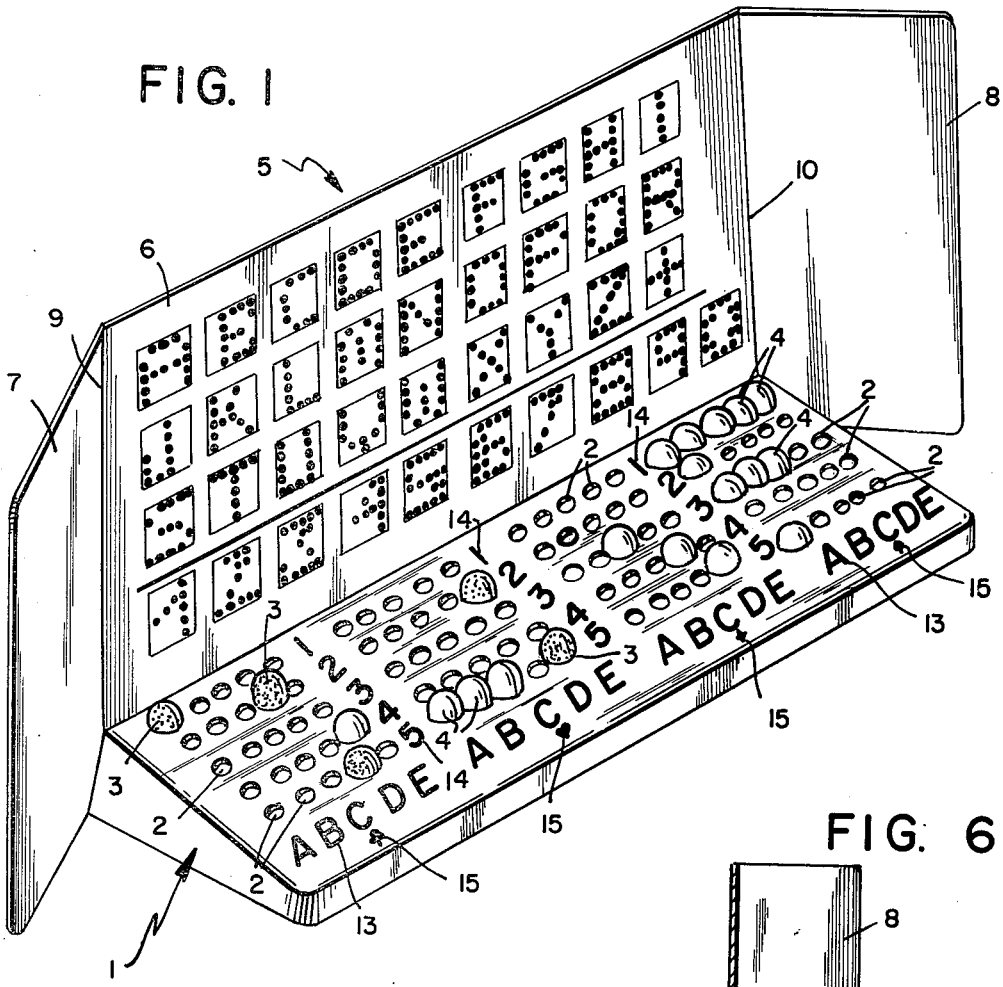
FIG. 1 is a perspective view of a guessing game, game board and shield in accordance with an embodiment of the invention.

Referring now to the drawings in detail, and first to FIG. 1 thereof, it may be seen that the game arrangement of the present invention includes a game board element 1 which has a plurality of holes, 2, arranged in respective rows and columns, a plurality of indicating pegs 3 and 4 which are of different colors, and a substantially flat shield 5 which has a central portion 6 and two lateral portions 7 and 8 which are hingedly connected to the central portion 6. While only one game board element 1 with the associated pegs 3 and 4 and shield 5 have been illustrated, it is to be understood that the game will include a number of the game board elements 1 corresponding to the highest number of players which can engage in the game. Then, all of the game board elements 1 and all of the shields 5 will have identical configurations, and the pegs 3 and 4 will be readily usable with all of the game board elements 1.

Figure 2:
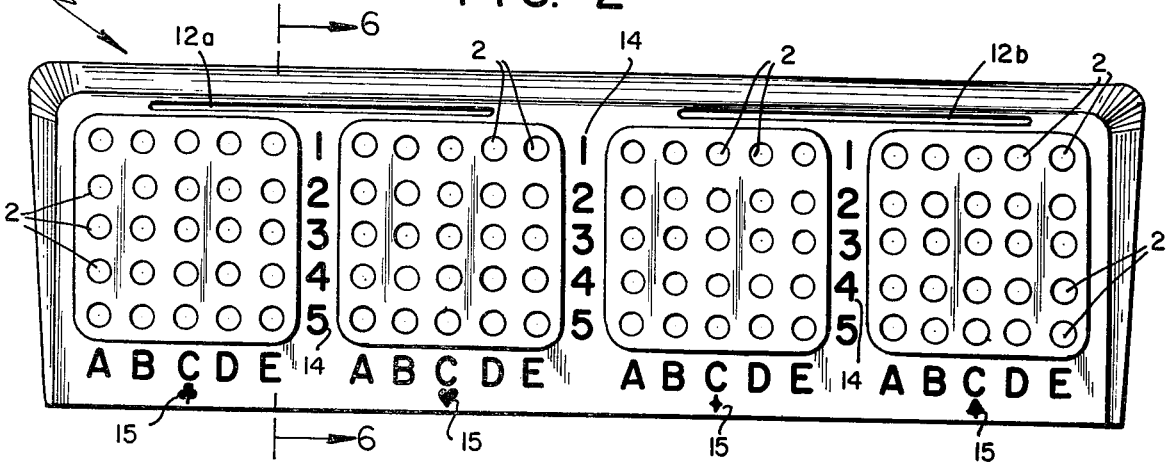
FIG. 2 is a top plan view of a game board element to be used in the arrangement of FIG. 1.

As particularly seen in the FIG. 2, the game board element 1 includes, in addition to four groups of the recesses or holes 2 which are arranged in respective rows and columns, at least one slot but preferably two separate and aligned slots 12*a* and 12*b* which are arranged at that side of the game board element 1 which is remote from the respective player associated with the game board element 1 during the game. The purpose of these partial slots will be explained later on.

It may also be ascertained from FIG. 2 that each of the columns of each of the groups of recesses 2 has an alphabet letter 13 associated therewith and that each of the rows of the recesses 2 is identified by a numeral 14. In addition thereto FIG. 2 shows that each of the groups of the recesses 2 has a symbol 15, such as a club, a heart, a diamond, or a spade, associated therewith.

Figure 3:
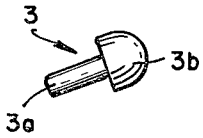
FIG. 3 is a side elevational view of an indicator peg adapted to be assembled with the game board element of FIG. 2.
Figure 4:
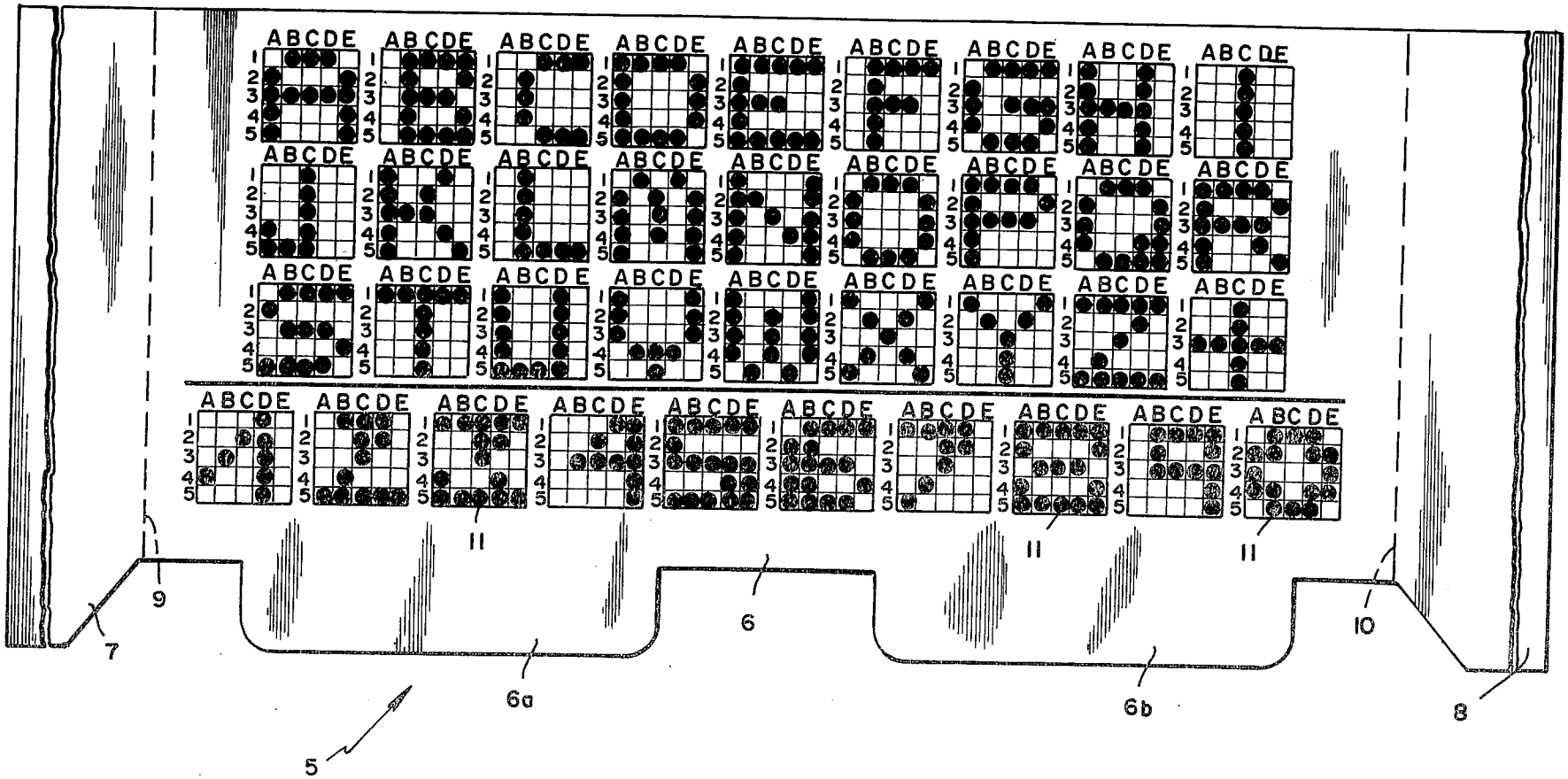
FIG. 4 is a front elevational view of a shield to be used in conjunction with the game board element of FIG. 2.
Figure 5:
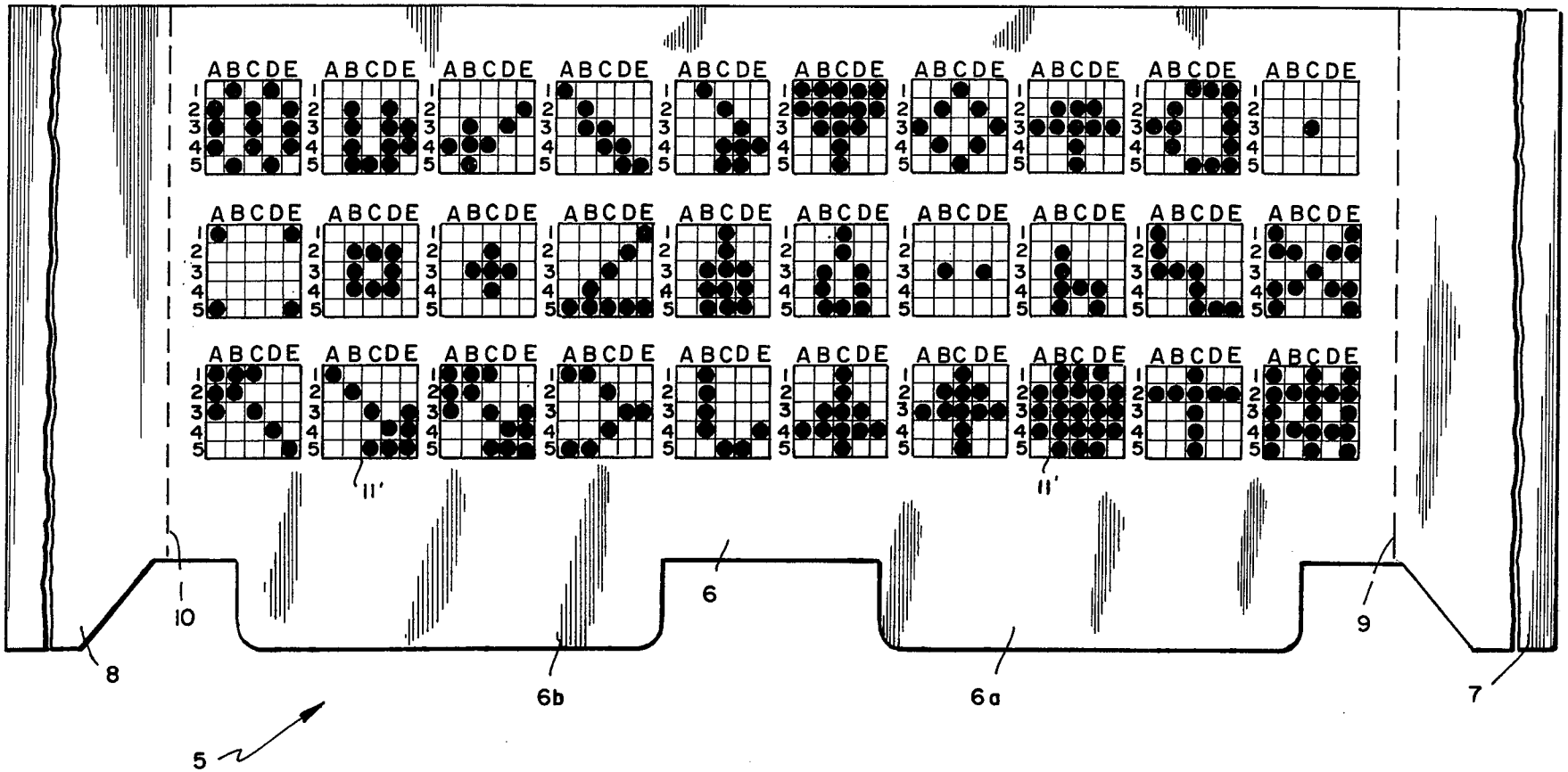
FIG. 5 is a rear elevational view of the shield of FIG. 4.

Turning now to FIG. 3, it is revealed therein that each of the pegs 3 and, similarly, also the peg 4, has a narrower leg portion 3*a* (or 4*a*), and a wider generally mushroom-shaped head portion 3*b* (or 4*b*). As illustrated in FIGS. 4 and 5, the central portion 6 of the shield 5 has two projections 6*a* and 6*b* each of which is received in one of the slots 12*a* and 12*b* mentioned above in connection with FIG. 2. Once the projections 6*a* and 6*b* are introduced into the slots 12*a* and 12*b*, they will maintain the respective shield 5 in the upright position which is illustrated in FIG. 1.

As also illustrated in FIGS. 4 and 5, the shield 5 has hinge portions 9 and 10, which may be constructed as weakened portions which hingedly connect the lateral portions 7 and 8, respectively, to the central portion 6 of the shield 5.

The central portion 6 of the shield 5 has two major surfaces, and a different set of patterns 11 or 11' is provided on each of these major surfaces.

Figure 6:
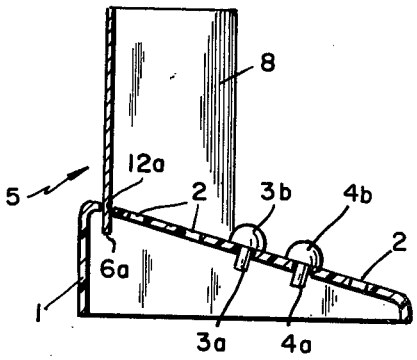
FIG. 6 is a cross-sectional view of the game board element taken on line 6—6 of FIG. 2.

Finally, FIG. 6 illustrates how the various components 1 to 5 of the game arrangement are assembled with one another. It may be seen therein that the projection 6*a* of the shield 5 is fittingly received in the partial slot 12*a* of the game board element 1, and that the leg portions 3*a* and 4*a* of the pegs or indicators 3 and 4 are received in the respective recesses 2 which, as illustrated, are configurated as through holes opening onto a playing surface of the game board element 1. On the other hand, the head portions 3*b* and 4*b* of the pegs 3 and 4 extend upwardly off, and rest on, the playing surface of the game board element 1.

Having so described the construction of the game board arrangement of the present invention, several possibilities of using the same for playing a game will now be discussed.

At the beginning of each particular game, the shields 5 are assembled with the respective game board elements 1. Then, the players will assume such positions relative to one another that the playing surface associated with the respective player will be completely concealed from view by the other players. When only two players are playing the game, the central portion 6 of the shield would, under most circumstances, completely conceal the playing surface of one of the players from the other player situated across the gaming table from the first-mentioned player. Under these circumstances, it is not necessary to pivot the lateral portions 7 and 8 relative to the central portion 6 about the respective hinges 9 and 10. However, when 3 or 4 players engage in the game, the lateral portions serve a useful purpose since they, in their pivoted positions, conceal the playing surface of the respective player from view by the player or players who is or are situated next to, as opposed to opposite from, the respective player.

Depending on which major surface of the central portion 6 of the shield 5 faces the players, in accordance with an agreement entered before assembling the shields with the respective game board elements 1, the players will then select one of the predetermined patterns 11 or 11' and will reproduce the same in one of the groups of recesses 2 which is identified with the same symbol 15 as that assigned by convention to the respective player.

Once each of the players has secretly copied the pattern selected from the respective set of patterns 11 or 11', the game proper is about to begin. The first player addresses the selected intersection of the rows and columns for a selected player, by identifying the player by calling for the respective symbol 15, identifying the column by calling for the respective alphabet letter 13, and by identifying the respective row by calling for the respective numeral 15. Now, the player identified by the symbol 15 will check if one of the pegs 3 is located at the called-for intersection of the rows and columns. Then, this player will indicate to the remaining players either the presence or absence of the peg 3 at that particular location. The other players will then record, on their respective game board elements 1, the established presence by using the peg 3, and the indicated absence by placing the peg 4, at the proper location of the group which is identified by the symbol 15 in question. The player identified by the respective symbol 15 however, will not make any change in the group containing his or her selected pattern, except that he may indicate the called-for intersection which is devoid of indicator 3 by placing a peg 4 thereat. In this manner, the originally selected pattern remains intact.

Thereafter, the next player proceeds in the same manner, and so on, until one of the players believes that he has sufficient information to be able to make an intelligent guess as to the pattern originally created by one of the other players. Then, this player, during his or her turn, will express an opinion as to what the respective pattern is. When the guess is correct, the player whose pattern has been so revealed, will leave the game. On the other hand, should the guess turn out to be incorrect, the player making the guess will leave the game. The game continues with the remaining players making their inquiries as to the locations of the pegs 3, or making guesses as to the patterns of the other players, until all but one of the players are eliminated from the game. Then, the remaining player is the winner.

As described so far, the game can be played by two, three or four players. Of course, if more than four groups of the recesses 2 were provided on each game board element, a larger number of players could participate. However, it will be appreciated that the above-described rules of the game could be varied in many respects.

So, for instance, the game could be so played as to depend on the memories of the players. Under these circumstances, only the pegs 3 are being used to indicate the original pattern selected by each of the players, and the pegs 4 indicating the absence of the pegs 3 will not be used at all, or will be used only to indicate those locations at which the presence of the indicators 3 of the other players has been already revealed, but not those locations which already have been called-for and indicated to be devoid of the indicators 3.

On the other hand, when only two players are involved, each of them can utilize two game board elements 1, and use one of them to form four patterns, one at each of the groups of recesses 2, while using the other game board element 1 for recording the information concerning the location of the indicators 3 of the other player. Here again, the task may be rendered even more difficult by relying on the memory for recording the information concerning the other player by not using the second-mentioned game board element 1. The challenge is even more increased when, instead of dispensing with the other game board element 1, the same is used for creating four additional patterns, for a total of eight for each player.

Moveover, when the game is being played by four players, two and two of them may be permitted to form a team and to consult with one another at regular intervals as to the strategy and tactic to be used against the other team. Of course, the rules of the game can be changed by agreement between or among the players, in addition to the modifications which have been discussed above.

It will be understood that, as various possible embodiments may be made of the above invention, and many changes may be made in the embodiment set forth above, all matter herein described or shown in the accompanying drawings is to be interpreted as illustrative only and not in a limiting sense. Thus, it will be appreciated by those skilled in the art that, although a preferred embodiment has been shown and described, the invention is not limited thereto or thereby. Rather, the scope of protection afforded will be determined exclusively with reference to the following claims.

I claim:

1. A game comprising, in combination, a game board including at least two spaced playing portions each for use by one of at least two players and each having markings thereon which are indicative of playing locations arranged at intersections of at least two intersecting arrays of imaginary lines; at least one set of indicators adapted to be so positioned at said playing locations as to be observable by the respective one and concealed from the other of the players and to form a pattern on the respective playing portion which conforms to at least one of a limited set of patterns available to the players for selection at the beginning of a particular game, and to be removed from the respective playing location of said playing portion of the one player when the position thereof at the respective intersection of said imaginary lines of said arrays is correctly guessed by the other player; and one or more concealment means with two major surfaces each of which has a different set of patterns to conceal each player's playing location.

* * * * *